US005344671A

United States Patent [19]

Wottrich

[11] Patent Number: 5,344,671

[45] Date of Patent: Sep. 6, 1994

[54] PROCESS AND DECORATIVE MATERIAL FOR PRODUCING A DECORATIVE SURFACE

[76] Inventor: Günther Wottrich, Weserstrasse 75, D-2940 Wilhelmshaven, Fed. Rep. of Germany

[21] Appl. No.: 992,076

[22] Filed: Dec. 17, 1992

[30] Foreign Application Priority Data

Dec. 21, 1991 [DE] Fed. Rep. of Germany ..... 4142596
Jan. 31, 1992 [DE] Fed. Rep. of Germany ..... 4202779

[51] Int. Cl.[5] ..... B05D 1/36
[52] U.S. Cl. ..... 427/192
[58] Field of Search ..... 427/192

[56] References Cited

U.S. PATENT DOCUMENTS 4,749,594 6/1988 Malikowski et al. ..... 427/192
5,059,485 10/1991 Parr et al. ..... 427/192

FOREIGN PATENT DOCUMENTS 6008894 7/1979 Japan ..... 427/192

*Primary Examiner*—Asok Pal
*Attorney, Agent, or Firm*—Speckman, Pauley & Fejer

[57] ABSTRACT

A process for refining the visual image of the surface of an object, preferably roofing materials. The invention also relates to an application to the surface of an object, preferably for executing the process. An appearance of a copper coating on arbitrary surfaces, in particular roofing made of modern materials is possible, particularly with the inclusion of the patina appearance. The application according to this invention is particularly inexpensive and simple to apply and weather-resistant, especially when used in roofing. The process of this invention is distinguished since the surface is provided with a coat of an application medium containing copper particles which have been subjected to oxidation.

13 Claims, No Drawings

PROCESS AND DECORATIVE MATERIAL FOR PRODUCING A DECORATIVE SURFACE

BACKGROUND OF THE INVENTION

1. Field of the Invention

This invention relates to a process for refining the visual image of the surface of an object, such as roofing. This invention also relates to an application to the surface of an object, preferably for executing the process of this invention.

2. Description of Prior Art

Often, copper roofs have been chosen as coverings for old buildings, for example churches or similar structures. With such copper roofs, copper sheets approximately 0.6 mm thick are placed on the roof surfaces on a wood base and fastened with nails. Such roofing structure requires an amount of copper of approximately 5 to 6 kg per square meter of roof surface.

Thus, roofs of this type are very expensive, not only because of materials, but also because of labor. It is also possible that local elements appear near the nails which may result in holes in the copper sheets which leads to corrosion and then to leaks in the roof. As a result, such a copper roof may require repairs relatively often, again at a high cost.

Possibly because of the special appearance of a copper roof, particularly the very attractive appearance of the greenish patina of such a copper roof, private home owners also have the desire, for aesthetic reasons, to select a copper roof for their home. However, because of the great expense they often are discouraged from this and prefer the proven and customary, less expensive materials for roofing.

SUMMARY OF THE INVENTION

It is one object of this invention to provide a process and a suitable application with which it is possible to provide the appearance of a copper coating to various surfaces, in particular roofing made of modern materials, and particularly with the inclusion of the patina appearance. According to this invention, the application is particularly inexpensive, simple and weather-resistant, especially when used in roofing.

The above and other objects of this invention are accomplished with a process wherein the surface is coated with an application medium containing copper particles which have been subjected to oxidation.

Thus, with the process of this invention an application medium is applied in an advantageous and simple manner to the surface of any object, such as roofing, facade or wall covering, a sculpture, an obelisk, a column or the like. Any paint-type application procedures can be used, for example brushing, rolling, spraying and so forth. The surface to be treated, such as the base, can be practically any surface.

The application medium according to this invention contains copper particles which are subjected to oxidation, i.e. they form a patina or verdigris, advantageously a very natural patina, since these are actual copper particles. Thus the treated surface has a completely natural appearance corresponding to a normal copper surface.

According to this invention, a different path is taken by means of the application medium of the invention than with customary bronze coatings, where only the respective metallic effect is imitated. Instead, copper plating is achieved in a simple and inexpensive manner with the application medium according to this invention, which otherwise would only be possible with cumbersome and expensive electrolysis, such as a process which would at best be profitable with sculptures.

The process of this invention also has an advantage in that functional, inexpensive construction materials can be used as bases, where their appearance is not important because the visible surface will be subsequently refined. Erosion of the application medium on the surface would only result in the necessity of repairing the application without the base being damaged in any way by this, so that roofing in particular would remain tight and weatherproof in spite of the erosion of the copper.

According to a further embodiment of the process according to this invention, the application medium comprises a bonding agent which can be applied separately from the copper particles in a two-stage process. First, the bonding agent can be brushed, rolled or applied in another manner. Then the copper particles can be dusted on, for example with of a fine-screen fine-dust process, preferably until an almost dry surface is achieved. The thickness of the bonding agent layer can be approximately 100 to 150 micrometers, for example.

The bonding agent can subsequently be hardened, for example hardened by heating and, if required, cooled down later. Next, the surplus copper particles can be removed, for example suctioned off. Thereafter the copper particles achieve a patina either by weathering over time or the speed of the process of patina creation can be increased by applying a special patina substance, for example a patina solution.

A particular advantage of this invention is that the copper particles can also advantageously be provided with a patina beforehand, so that the refined surface immediately shows a relatively even patina.

Thus, it is possible to apply the bonding agent, possibly an extender, and the entire amount of copper to be used as a homogeneous mixture with supercritical pigment-volume concentration on the substrate surface having an adhesive base. Alternatively, it is possible to apply the bonding agent, possibly the extender, and a portion of the amount of copper to be used to the substrate as a homogeneous mixture with a subcritical pigment-volume concentration, and the remaining portion of copper particles applied afterwards, for example by using a fine-screen fine-dust process, preferably until an almost dry surface and a supercritical pigment-volume concentration are achieved.

The two-stage process has one advantage in that priming the substrate is not necessary, because the applied coating has a subcritical pigment-volume concentration. Good adhesion of the coating on the substrate is assured by this preferred embodiment. Also, because the proportion of copper is extremely high in the area of the coating surface, that is, a highly supercritical pigment volume concentration, good and rapid patina formation is possible.

In both preferred embodiments, the thickness of the coating layers should be approximately 100 to 150 micrometers.

After hardening of the bonding agent (physically drying, oxidatively, cold- or heat-hardening), possibly excessive copper particles of the second preferred embodiment of the process of this invention, as discussed above, can be removed, for example suctioned off, and recycled to the process.

Next, the top copper particles of the coating can attain a patina either by atmospheric effects, or the patina can be attained by special patina assists, for example patina solutions. Another particular advantage of the process of this invention is that easy and rapid patina formation is possible with machine processing and in this way articles with an even patina which are therefore visually refined are available. The application process in accordance with the first preferred embodiment discussed above is particularly suitable for shapes with highly structured surfaces.

The application process in accordance with the second preferred embodiment discussed above is particularly suitable for machine coating of flat substrates, such as roofing materials of all types.

The proportional ratio of copper particles to the bonding agents prescribes defined properties of the application medium. If the proportion of copper is too high, the consistency of the coating may possibly be reduced; if the proportion of copper is too low, the desired appearance of copper may possibly not be achieved. With the process of this invention, the proportion of copper may easily be only slightly below the critical pigment-volume concentration.

The copper particles can be bound into the bonding agent or, as previously mentioned, subsequently applied in a two-stage process. Subsequent application has additional advantages. Essentially only the bonding agent comes into contact with the substrate, which assures particularly good adhesiveness. The outer layer of the application medium is mainly formed by copper particles, so that the exterior appearance is particularly copper-like and large portions of the surface of the copper particles are exposed to oxidation to form a patina.

The application medium according to this invention is particularly distinguished by copper particles exposed to oxidation. These copper particles can also comprise one or a plurality of copper compounds.

The application medium preferably has a bonding agent added to it, into which the copper particles can be bound. In a preferred embodiment of this invention, the bonding agent can have a porous structure which provides improved embedding of the copper particles.

The pigment-volume concentration in the individual zones of the coating is responsible to a large extent for the chemical and mechanical properties of the coating, that is, for the formation of a patina, erosion resistance, and adhesiveness on the substrate. A subcritical pigment-volume concentration should be the goal to achieve good adhesiveness in the boundary area between substrate surface and coating, but on the surface where the patina is generated a supercritical pigment-volume concentration is preferred for rapid reaction of the copper.

The coating in accordance with this invention is distinguished since the copper particles easily attain a patina. These copper particles can also comprise copper compounds such as oxides or salts.

Preferably the coating system in the forms described shows good fixation of the copper particles as well as of the corroded or patinated copper particles because of the porous structure of the bonding agent, particularly in the area of critical and supercritical pigment-volume concentration, which considerably reduces mechanical wear because of weather effects.

Many different commercially available bonding agents can be used, particularly bonding agents of synthetic resin. Basically, these can be inorganic or organic, solvent-free or solvent-containing or bonding agents which can be diluted with solvents or water. It is possible to choose a bonding agent suitable for the respective base.

In addition, an extender can be added to the bonding agent, which preferably is well homogenized with the bonding agent.

The following examples of bonding agents can be used: setting mortars and sulfate, so-called asbestos cement, sodium and potassium waterglass, organic silicates, polyurethanes, epoxy systems, chlorine rubber, oxidatively-drying resins, unsaturated polyesters, thermoplastic materials, polyisocyanates, polyetherpolyol. The following examples of fillers or extenders can be used: quartz powder, kaolin, talcum, natural aluminum, and magnesium silicate hydroxides.

Recipes and operational procedures are recited below by way of examples for defined uses.

DESCRIPTION OF PREFERRED EMBODIMENTS

EXAMPLE I

Coating of Bitumen-based Roofing

Bonding: Solvent-containing epoxy resin reaction coating—reacts at low temperature, moisture-hardening 1K-PUR coating, contains solvents.

Easy etching of the substrate surface is achieved with the use of bonding agents containing solvents. A mixing zone between the bonding agent and the bitumen is formed, which results in good adhesion of the bonding agent on the substrate.

General Recipes

Epoxy resin system, containing solvents, cold-hardening.

| | |
|---|---|
| Resin components: | |
| Araldit 6071 (Ciba-Geigy) | 38.5 parts |
| Xylol | 6.0 parts |
| Isobutyl-methyl-ketone | 6.0 parts |
| Ethane diol | 1.0 part |
| Urea resin (Laromine, BASF) | 2.0 parts |
| Filler or "Extender" (Quartz powder, barium sulfate, kaolin, aluminum- and magnesium silicate hydroxides, etc.) | 36.5 parts |
| Hardener: | |
| Triethylene tetramine | 2.2 parts |
| Xylol | 9.0 parts |
| Butanol-2 | 8.8 Parts |
| | 20.0 parts |
| Resin/hardener mixing ratio | 4.5:1 |
| Moisture-hardening 1K-Pur-System | |
| Desmodur E - solvent containing (Bayer) | 50 parts |
| Filler "Extender" - see pre-recipe | 40 parts |

For coating of wavy substrate surfaces it is possible to perform thixotropy of both systems using "Aerosil-Degussa". This prevents run-off from inclined surfaces.

Operational Procedure

Apply bonding agent to the substrate surface (rolling, spraying), coat thickness 100–150 $\mu$m.

Apply the copper powder using a fine-screen fine-dust process until an almost dry surface is obtained.

There is a clearly supercritical pigment-volume concentration in the area of the surface, a good reaction surface for the patinating solution, while subcritical pigment-volume concentration as well as a mixing phase between bonding agent and bitumen is present in the boundary area between the substrate and coating.

Hardening preferably occurs at room temperature or slightly elevated temperatures up to approximately 60° C. The maximum temperature is limited by the thermal properties of the substrate.

Suction off, and recycle if desired, possibly unbound copper.

Patination

EXAMPLE II

Coating of Shaped Bodies of Concrete, Stone, and other Inorganic Materials

| | |
|---|---|
| Coating mass: | |
| Bonding agent: | 70 parts |
| Chlorine rubber (Pergut S 20, 50% solution in toluol Bayer) | |
| Filler or "Extender" | 55 parts |
| Quartz powder, kaolin, natural aluminum- and magnesium silicate hydroxide | |
| Copper powder | 55 parts |

If necessary, set to a consistency suitable for brushing by the addition of xylol.

Operational Procedure

If required, clean and dry the object.

Apply a primer of 30 to 50 μm thickness on the basis of chlorine rubber with subcritical pigment-volume concentration can be used to improve adhesiveness.

Dry the primer (evaporation of the solvent).

Apply the top coat with a thickness of 100 to 150 μm, thicker in exposed places if needed.

Dry the coating (evaporation of the solvent).

Apply the patination solution.

This step can be repeated, depending on the desired degree of patina.

The following substances are suitable as patination solutions:

| | |
|---|---|
| Ammonia chloride | 40 g/l |
| Potassium tartrate | 120 g/l |
| Sodium chloride | 160 g/l |
| Copper nitrate | 200 g/l |

The above solution is used to create a blue-green patina.

| | |
|---|---|
| Copper nitrate (dissolve in 50 ml demineralized water, precipitate the copper with ammonia and dissolve by further additions) | 25 g |
| add 6% acetic acid | 100 ml |
| add ammonium chloride to the | 100 g |

-continued

| |
|---|
| solution |

This solution provides a dark-green (Pompeian green) patina.

| | |
|---|---|
| Ammonium carbamate | 250 g/l |
| Ammonium chloride | 205 g/l |

This solution provides an intensely light green coloration when applied alternately with hydrogen peroxide.

What is claimed is:

1. A process for producing a decorative surface of a structure selected from the group consisting of a roofing member, a wall member, a facade member, a sculpture member, an obelisk member, and a column member, comprising the steps of: applying an application medium comprising copper particles to the structure and oxidizing the copper particles to form a patina.

2. A process in accordance with claim 1, wherein the copper particles are oxidized prior to applying the application medium to the decorative surface until a patina-green coloration of the copper particles is generated.

3. A process in accordance with claim 2, wherein a bonding agent is first applied to the decorative surface after which the surface, coated with the bonding agent, is dusted with the copper particles.

4. A process in accordance with claim 3, wherein the bonding agent comprises a portion of the copper particles and an extender, the bonding agent is applied to the surface of the substrate, and the surface is then dusted with a remainder of the copper particles until a supercritical pigment-volume concentration is achieved.

5. A process in accordance with claim 4, wherein the bonding agent is subsequently hardened.

6. A process in accordance with claim 5, wherein the bonding agent is heat-hardening and the bonding agent is cooled after the bonding agent is hardened.

7. A process in accordance with claim 6, wherein surplus copper particles which are not bound to the decorative surface are removed by suctioning.

8. A process in accordance with claim 1, wherein a patination substance is used for patination.

9. A process in accordance with claim 1, wherein a bonding agent is first applied to the decorative surface after which the surface, coated with the bonding agent, is dusted with the copper particles.

10. A process in accordance with claim 3, wherein the application medium, comprising a supercritical pigment-volume concentration, is applied to the decorative surface, which has an adhesion layer.

11. A process in accordance with claim 3, wherein the bonding agent is subsequently hardened.

12. A process in accordance with claim 3, wherein surplus copper particles which are not bound to the decorative surface are removed by suctioning.

13. A process in accordance with claim 2, wherein a patination substance is used for patination.

* * * * *